US005576078A

United States Patent [19]

Schatz

[11] Patent Number: 5,576,078

[45] Date of Patent: Nov. 19, 1996

[54] ILLUMINATED CHRISTMAS ORNAMENT

[76] Inventor: Alan G. Schatz, 65-47 160th St., Flushing, N.Y. 11365

[21] Appl. No.: 410,919

[22] Filed: Mar. 27, 1995

[51] Int. Cl.[6] ..... F21V 1/00

[52] U.S. Cl. ..... 428/13; 362/31; 428/192; 428/912.2

[58] Field of Search ..... 428/7, 11, 192, 428/912.2, 13; 362/31

[56] References Cited

U.S. PATENT DOCUMENTS

| | | | |
|---|---|---|---|
| 3,740,543 | 6/1973 | Frane | 428/7 X |
| 4,452,836 | 6/1984 | Daniel, Jr. | 428/11 |
| 4,833,580 | 5/1989 | Allen | 428/11 X |
| 5,106,660 | 4/1992 | Vorel | 428/13 |
| 5,303,490 | 4/1994 | Yang | 428/13 X |
| 5,367,806 | 11/1994 | Hoffman | 40/544 |

*Primary Examiner*—Henry F. Epstein
*Attorney, Agent, or Firm*—Michael I. Kroll

[57] ABSTRACT

An illuminated Christmas ornament which comprises a transparent member having an aperture in a top edge, a light fixture land a light bulb carried in the light fixture. A component is for electrically connecting the light fixture to a socket of a conventional master light string. A structure is for clamping the light fixture to the transparent member adjacent the top edge with the light bulb extending into the aperture, so that the light bulb can provide illumination to the transparent member.

3 Claims, 2 Drawing Sheets

ILLUMINATED CHRISTMAS ORNAMENT

BACKGROUND OF THE INVENTION

1. Field of the Invention

The instant invention relates generally to decorative displays and more specifically it relates to an illuminated Christmas ornament.

2. Description of the Prior Art

Numerous decorative displays have been provided in prior art. For example, U.S. Pat. Nos. 3,740,543 to Franc; 5,106,660 to Vorel; 5,303,490 to Yang and 5,367,806 to Hoffman all are illustrative of such prior art. While these units may be suitable for the particular purpose to which they address, they would not be as suitable for the purposes of the present invention as heretofore described.

FRANC, CHARLES

BATTERY POWERED ILLUMINATED ORNAMENT

U.S. Pat. No. 3,740,543

A portable, illuminated ornament for illuminating a greeting card, gift package or the like, consisting of a flat, substantially rectangular battery having a horizontally disposed, rectangular-shaped positive terminal affixed to one side thereof. A negative battery terminal, consisting of the battery casing and a rectangular member affixed to the same side of the battery as the positive terminal, is disposed parallel to the positive terminal. Either the positive or negative terminal may be provided with an aperture for receiving the base of a flame-shaped lamp. The ornament may be mounted in a greeting card which has an aperture in one surface thereof behind which the flame-shaped lamp is disposed, and an elongated slot which receives a flat tab disposed between the lamp base and the battery terminal to control illumination of the lamp.

VOREL, MARK S.

DECORATIVE WALL PANEL.

U.S. Pat. No. 5,106,660

A decorative display panel is formed by spaced transparent panes defining a space containing preferably water. A porous tube at the bottom of the space is supplied preferably with air under pressure to generate a curtain of bubbles moving upward in the water. The assembly is illuminated by edge lighting. The unit can be either free-standing, or incorporated in a partition system.

YANG, STEVE

DISPLAY SHOWING MOVABLE ORNAMENTS

U.S. Pat. No. 5,303,490

A display device has a housing in which sound (a music IC), light (light strings), and power (light string AC motors) elements are combined. At least one master light string is used as the power source, supplying the AC motor necessary power so that the motor can drive a transmission mechanism. Ornaments connected to the transmission mechanism are then movable in the display device providing an attractive and lovely scene. Separate toy figures having an independent light string AC motor may be directly connected to the light string which provides power required for the toy figures to move in a designed manner.

HOFFMAN, PETER

ILLUMINATED SIGN

U.S. Pat. No. 5,367,806

An improved illuminated sign for adhesive bonding to the inner surface of a pane of transparent material such as the glass of an automotive window comprises a backing panel, a planar electro-luminescent lamp, and an indicia-bearing member. The indicia-bearing member is smaller in planar extent than an assembly of the backing panel and the lamp. Strips of double-sided adhesive tape are applied to the border of the backing panel. The second adhesive surface of the tape is used to bond the assembly of the backing panel, the lamp and the indicia-bearing member to the inner surface of an automobile window or the like.

SUMMARY OF THE INVENTION

A primary object of the present invention is to provide an illuminated Christmas ornament that will overcome the shortcomings of the prior art devices.

Another object is to provide an illuminated Christmas ornament that can be connected to a conventional master light string in a quick manner involving no complicated assembly techniques or special tools.

An additional object is to provide an illuminated Christmas ornament in which a clear block-shaped member with indicia printed thereon, will be illuminated by a light bulb in a light fixture clamped thereto, that is connected to a socket of the conventional master light string.

A further object is to provide an illuminated Christmas ornament that is simple and easy to use.

A still further object is to provide an illuminated Christmas ornament that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
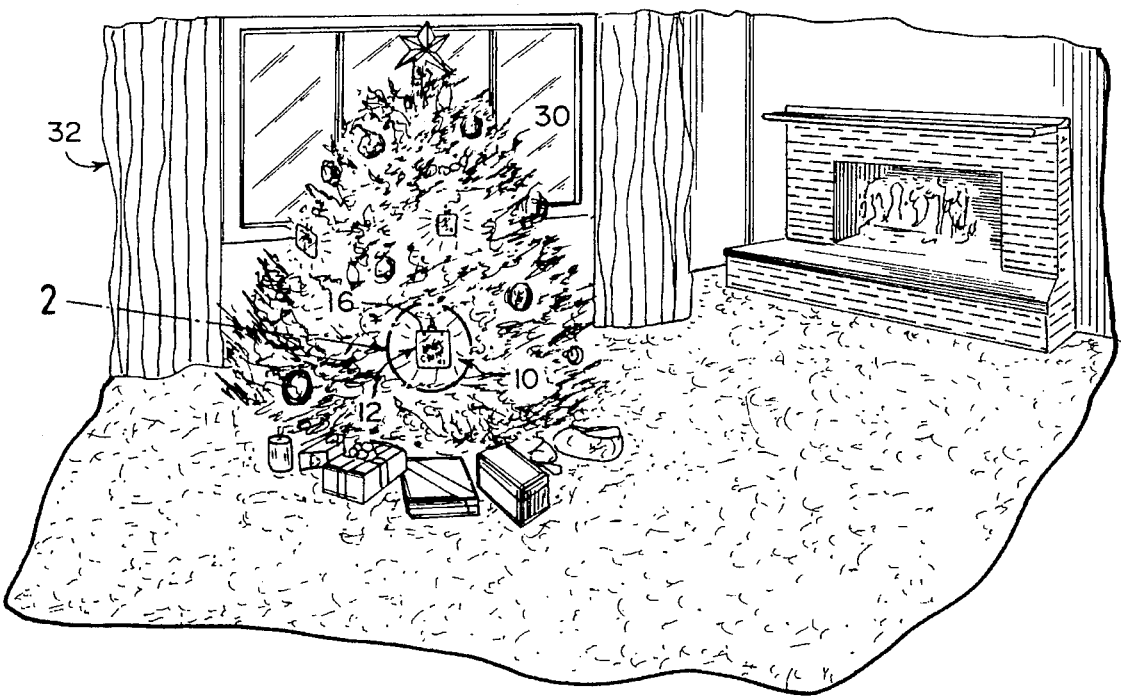
FIG. 1 is a perspective view of a portion of a room, showing the instant invention installed into a conventional master light string on a Christmas tree.

Turning now descriptively to the drawings, in which similar reference characters denote similar elements throughout the several views, FIGS. 1 through 4 illustrate an illuminated Christmas ornament 10 which comprises a transparent member 12 having an aperture 14 in a top edge 16, a light fixture 18 and a light bulb 20 carried in the light fixture 18. A component 22 is for electrically connecting the light fixture 18 to a socket 24 of a conventional master light string 26. A structure 28 is for clamping the light fixture 18 to the transparent member 12 adjacent the top edge 16 with the light bulb 20 extending into the aperture 14, so that the light bulb 20 can provide illumination to the transparent member 12. The conventional master light string 26 can be hung on a Christmas tree 30 in a room 32, as shown in FIG. 1.

Figure 2:
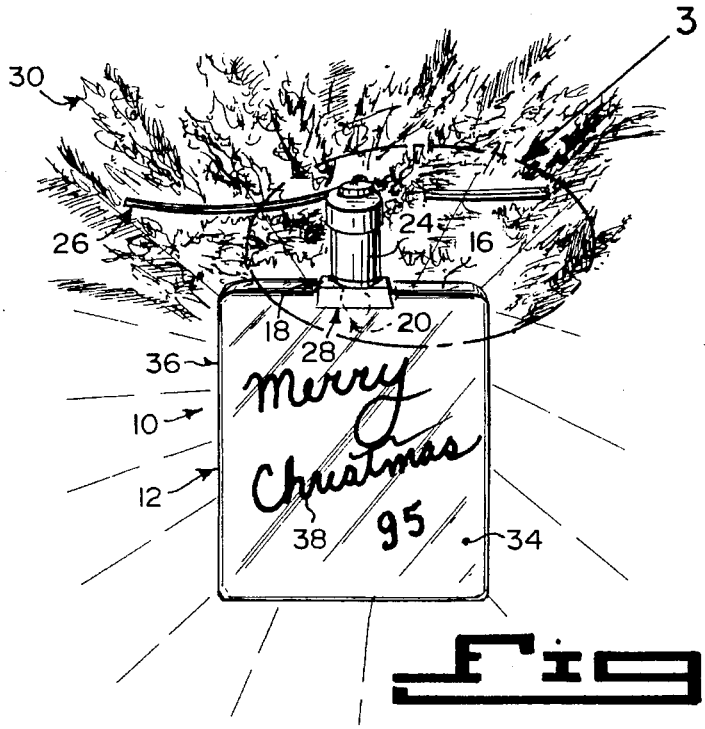
FIG. 2 is an enlarged perspective view as indicated by arrow 2 in FIG. 1, of the instant invention in greater detail.
Figure 3:
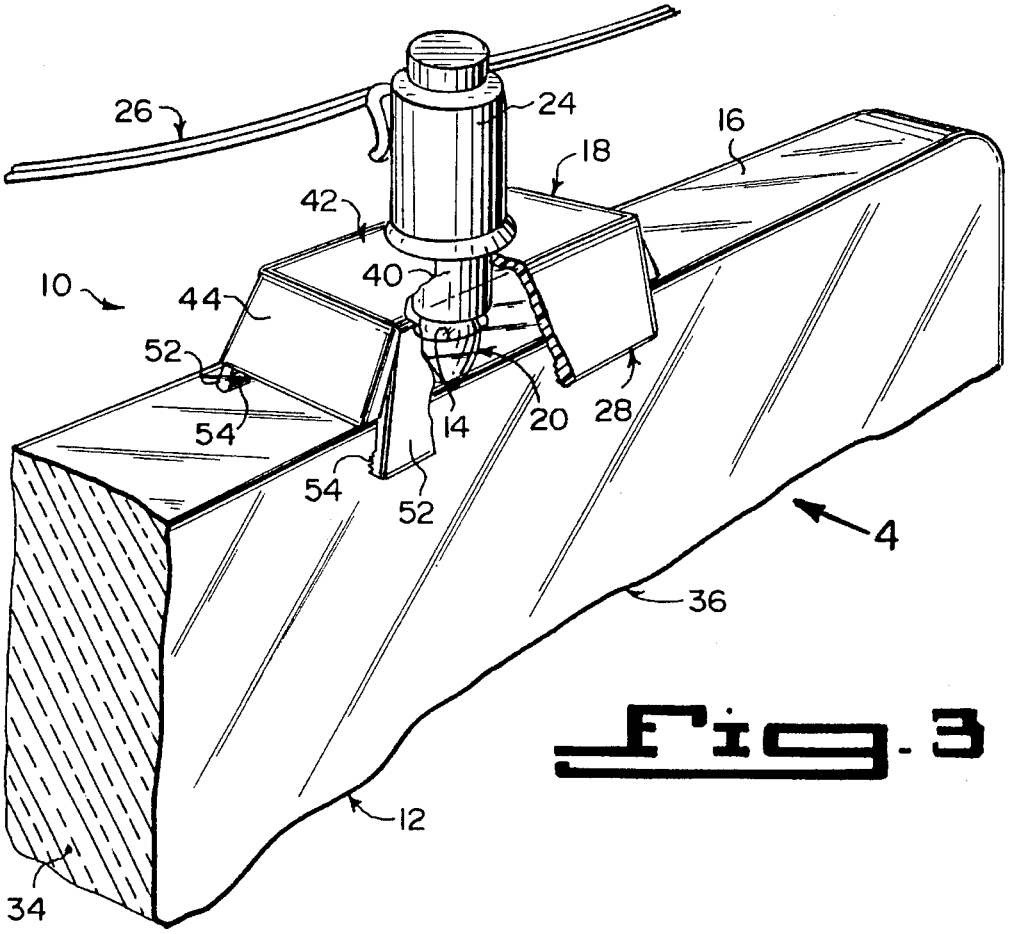
FIG. 3 is a further enlarged perspective view with parts broken away and in section of a portion of the instant invention as indicated by arrow 3 in FIG. 2.
Figure 4:
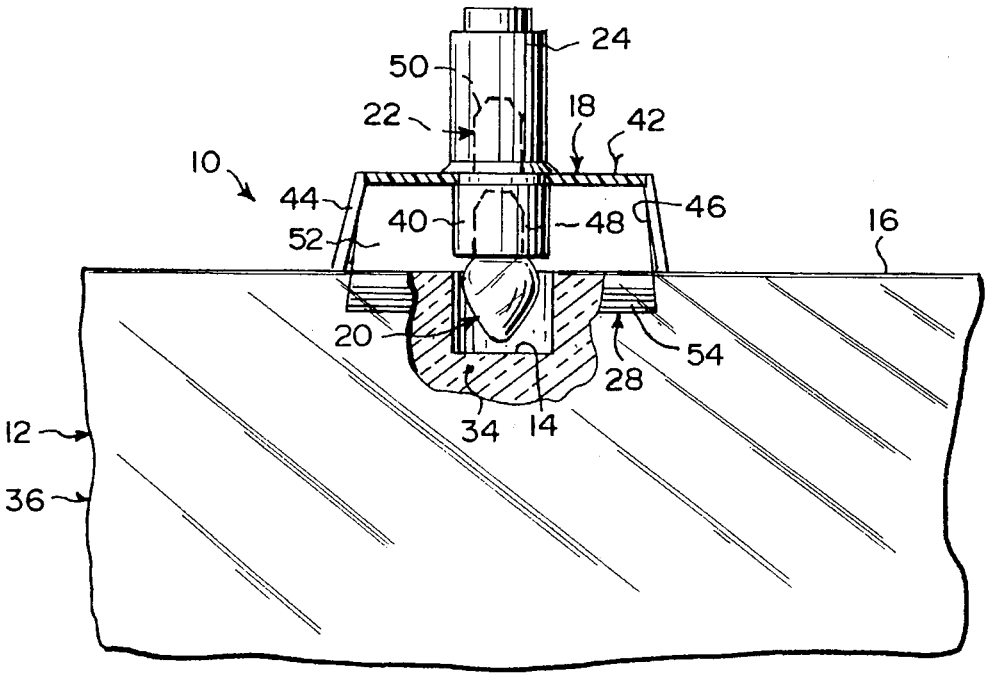
FIG. 4 is a front elevational view with parts broken away and in section taken in the direction of arrow 4 in FIG. 3.

The transparent member 12 is fabricated out of a light, permanently clear, weather-resistant thermoplastic resin 34. The transparent member 12 is a rectangular block-shaped tablet 36. The transparent member 12, as best seen in FIG. 2, is printed with indicia 38 thereon. The indicia 38 is selected from the group consisting of a picture, a logo, a trademark and advertising material.

The light fixture 18 consists of an internally threaded light receptacle 40. An element 42 is connected to the light receptacle 40, for directing the illumination from the light bulb 20 down into the transparent member 12. The illumination directing element 42 is a shade 44. The light fixture 18 further includes a reflective inner surface 46, to help cast back the illumination from the light bulb 20 down into the transparent member 12.

The light bulb 20 contains an externally threaded base 48 that is threadable into the internally threaded light receptacle 40 of the light fixture 18. The electrically connecting component 22 is an externally threaded cylindrical plug 50 extending from an end of the internally threaded light receptacle 40 in the light fixture 18. The externally threaded cylindrical plug 50 is threadable into the socket 24 of the conventional master light string 26.

The clamping structure 28 includes a pair of flexible jaws 52, formed on opposite sides of the light fixture 18. The flexible jaws 52 will grip the transparent member 12 adjacent the top edge 16. Each flexible jaw 52 contains inner facing teeth 54, to better grip the transparent member and prevent slippage therefrom.

OPERATION OF THE INVENTION

To use the illuminated Christmas ornament, the following steps should be taken:

1. Thread the externally threaded base 48 of the light bulb 20 into the internally threaded light receptacle of the light fixture 18.
2. Thread the externally threaded cylindrical plug 50 into the socket 24 of the conventional master light string 26 which may be on the Christmas tree 30.
3. Engage the flexible jaws 52 with the inner facing teeth 54 to the transparent member 12 adjacent the top edge 16, so that the light bulb will enter the aperture 14.
4. Plug in the conventional master light string 26 to a power source, to illuminate the light bulb 20 which in turn will illuminate the transparent member 12.
5. The indicia 38 will also be illuminated on the transparent member 12, so as to be viewed on the Christmas tree 30.

LIST OF REFERENCE NUMBERS

10 illuminated Christmas ornament
12 transparent member
14 aperture in 16
16 top edge of 12
18 light fixture
20 light bulb
22 electrically connecting component
24 socket of 26
26 conventional master light string
28 clamping structure
30 Christmas tree
32 room
34 light permanently clear, weather-resistant thermoplastic resin of 12
36 rectangular block-shaped tablet for 12
38 indicia on 12
40 internally threaded light receptacle of 18
42 illumination directing element of 18
44 shade for 42
46 reflective inner surface on 44
48 externally threaded base of 20
50 externally threaded cylindrical plug for 22
52 flexible jaw of 28
54 inner facing teeth on 52

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An illuminated Christmas ornament which comprises:

a) a transparent member consisting of a solid block of permanently clear and transparent weather-resistant thermoplastic resin having an aperture in a top edge;

b) a light fixture carrying a light bulb extending into said aperture comprising an internally threaded light receptacle and shade means supporting said light receptacle, enclosing the top edge of said block surrounding said receptacle and directing the illumination from said light bulb down into said transparent member, said aperture being only large enough to contain said light bulb;

c) said shade means including a reflective inner surface to help cast back the illumination from said light bulb down into said transparent member;

d) means for electrically connecting said light fixture to a socket of a conventional master light string; and e) said shade means including a pair of flexible jaws with inner facing teeth formed on opposite sides of said light fixture gripping opposite surfaces of said block for clamping said light fixture to said transparent member adjacent said top edge with said light bulb extending into said aperture, so that said light bulb can provide illumination to said transparent member.

2. An illuminated Christmas ornament as recited in claim 1, wherein said transparent member is printed with indicia thereon.

3. An illuminated Christmas ornament as recited in claim 2, wherein said indicia is selected from the group consisting of a picture, a logo, a trademark and advertising material.

* * * * *